US006176371B1

(12) United States Patent
Tyrrell

(10) Patent No.: US 6,176,371 B1
(45) Date of Patent: Jan. 23, 2001

(54) BIOLOGICAL SAMPLE STORAGE PACKAGE AND METHOD FOR MAKING SAME

(75) Inventor: Steven P. Tyrrell, Highland Park, IL (US)

(73) Assignee: Biosafe Laboratories, Inc., Chicago, IL (US)

( * ) Notice: Under 35 U.S.C. 154(b), the term of this patent shall be extended for 0 days.

(21) Appl. No.: 09/374,412

(22) Filed: Aug. 13, 1999

(51) Int. Cl.[7] ..... B65D 81/26

(52) U.S. Cl. ..... 206/204; 206/569; 53/469; 53/477

(58) Field of Search ..... 206/204, 569, 206/363, 438, 439, 484, 524.1; 53/467, 469, 474, 477; 383/38, 63, 113

(56) References Cited

U.S. PATENT DOCUMENTS 4,579,223 * 4/1986 Otsuka et al. ..... 206/204
5,660,868 * 8/1997 Yeager ..... 206/204
5,698,217 * 12/1997 Wilking ..... 206/204
5,791,485 * 8/1998 Carbonneau ..... 206/204
5,833,058 * 11/1998 Mabry ..... 206/204

* cited by examiner

*Primary Examiner*—Luan K. Bui
(74) *Attorney, Agent, or Firm*—Brinks Hofer Gilson & Lione

(57) ABSTRACT

A biological sample storage package includes a pouch formed of a material that is impermeable to water vapor and a container formed of a material that is permeable to water vapor and/or oxygen. The container is filled with an absorbent material such as a desiccant, and the container is disposed in the pouch and secured to the pouch such that the desiccant container cannot be removed from the pouch inadvertently. A resealable closure is provided to seal the pouch after a biological sample has been placed in the pouch. The desiccant container can be heat sealed along two opposed sides and one end between the sheets that form the pouch.

17 Claims, 2 Drawing Sheets

BIOLOGICAL SAMPLE STORAGE PACKAGE AND METHOD FOR MAKING SAME

BACKGROUND

The present invention relates to a biological sample storage package that provides a stable environment for a biological sample such as a blood sample being stored and optionally transported.

In the past, zip-seal closures have been used in combination with polymer sheet bags to form storage packages for biological samples. Typically, the bags are formed of a metallized polymer sheet that is substantially impermeable to water vapor and opaque. In the past, loose bags of desiccant have been placed in such storage packages to dry the interior of the bag and the biological sample contained in the bag.

In one prior-art application, a sample storage package of the type described above contains a biological sample collection device and a loose bag containing a desiccant. The user then opens the storage package, removes the collection device, uses the collection device to collect a biological sample, and then returns the collection device to the interior of the storage package. The storage package is then sealed for transport of the biological sample. In the past, difficulties have been encountered when the loose desiccant bag is removed from the storage package but not returned prior to the time the biological sample collection device is resealed into the storage package. Furthermore, a loose desiccant bag provides another separate item, which may cause confusion with some users.

Thus, a need presently exists for an improved biological sample storage package that provides a stable environment for a biological sample being transported, but that is easier and more reliable to use.

SUMMARY

By way of introduction, the preferred embodiment described below provides a pouch formed of a material that is substantially impermeable to water vapor. A closure is included in the pouch to seal the pouch after a biological sample has been placed in the pouch. A container formed of a second sheet material that is permeable to at least one of water vapor and oxygen is secured to the first sheet material of the pouch and disposed within the pouch. The container contains an absorbent material that is operative to absorb water vapor and/or oxygen. Because the container is secured to the pouch, the potential for inadvertent misuse is substantially reduced. The container is disposed in the pouch and secured to the pouch, and the user is not faced with two separable items that may be lost or separated from one another. The preferred method for fabricating the storage package described below is particularly cost efficient.

The foregoing paragraph has been intended by way of introduction, and is not intended to limit the scope of the following claims.

DETAILED DESCRIPTION OF THE PRESENTLY PREFERRED EMBODIMENTS

Figure 1:
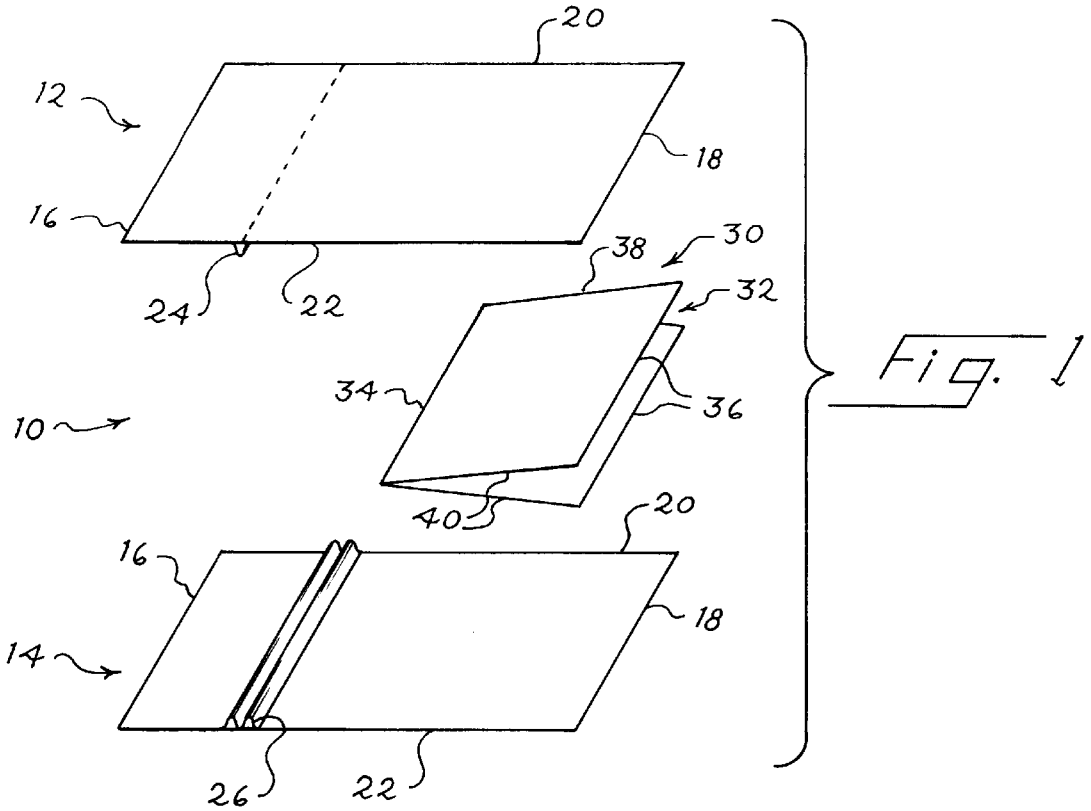
FIG. 1 is an exploded perspective view of components of a biological sample storage package that incorporates a preferred embodiment of this invention, prior to assembly.

Turning now to the drawings, FIG. 1 shows the major structural components of a sample storage package 10, prior to assembly. These components include first and second flexible polymeric sheets 12, 14 formed of a first sheet material that is substantially impermeable to water vapor and opaque to optical radiation. The first and second sheets 12, 14 define first and second opposed ends 16,18 and first and second opposed sides 20, 22. The first sheet 12 supports a first zip-seal closure portion 24, and the second sheet 14 supports a second zip-seal closure portion 26. The closure portions 24, 26 are shaped to resealably seal against one another.

Also shown in FIG. 1 are third and fourth sheets 30, 32 formed of a second polymeric sheet material that is permeable to water vapor and/or oxygen. The third and fourth sheets 30, 32 define opposed first and second ends 34, 36 and opposed first and second sides 38, 40. In this embodiment, the third and fourth sheets 30, 32 are constructed from a single piece of polymeric material, and are connected at a fold region at the first end 34.

In a first stage of fabrication, the first and second sheets 12, 14 are aligned outside of the third and fourth sheets 30, 32, with the closure portions 24, 26 sealed together.

Figure 2:
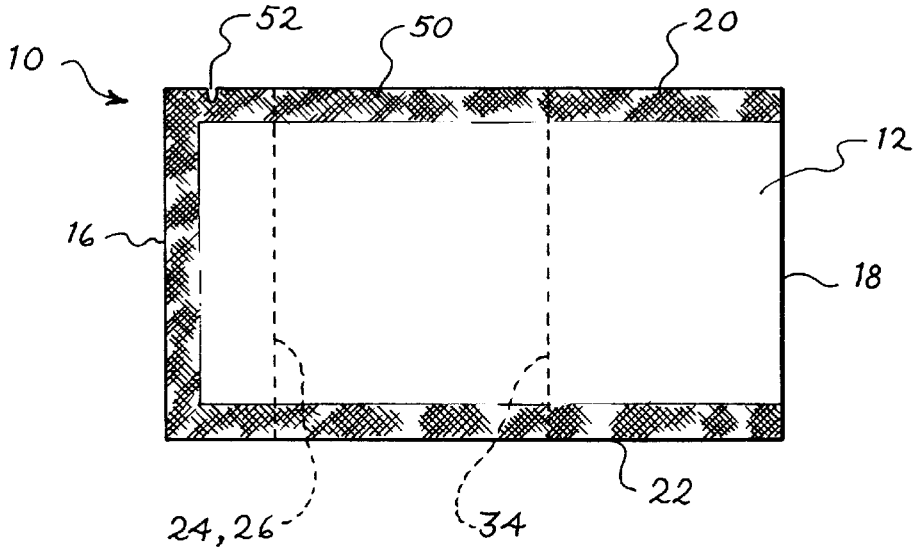
FIG. 2 is a top view showing the biological sample storage package at a first stage of fabrication.

In a second stage of fabrication, a heat seal 50 is formed as shown by the lined region of FIG. 2. The heat seal 50 extends completely across the first end 16 of the first and second sheets and completely along both of the two opposed sides 20, 22 of the first and second sheets. Once the heat seal 50 has been formed, the first and second sheets, which form the outer portion of the storage package, are hermetically sealed together along the entire length of first end 16 and both of the opposed sides 20, 22. The act of sealing the first and second sheets together simultaneously seals the two opposed sides of the third and fourth sheets together, thereby closing the container formed by the third and fourth sheets on the two opposed sides. As explained previously, the fold region closes the container at one end, and the other end aligned with the end 18 of the sheet 12 is open, both for the pouch formed by the first and second sheets, and for the container formed by the third and fourth sheets.

When the heat seal 50 is formed, the perimeter of the storage package 10 can be trimmed, and a notch 52 can be formed to facilitate opening of the package.

Figure 3:
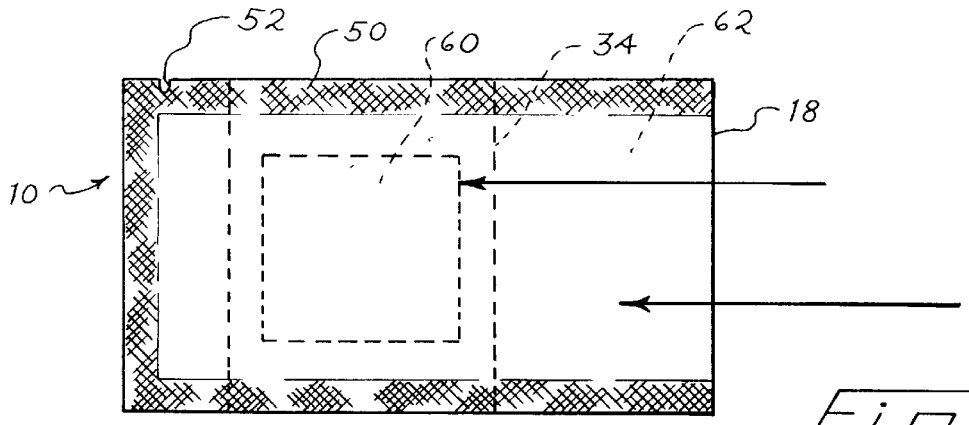
FIG. 3 is a top view corresponding to FIG. 2 showing the sample storage package at a second stage of fabrication.

In a third stage of fabrication as shown in FIG. 3, a blood collection device 60 is inserted into the pouch via the open end 18 and an absorbent material 62 such as a desiccant is inserted into the container formed by the third and fourth sheets via the open end 36.

The biological sample collection device 60 can take many forms, depending upon the application. In one preferred embodiment, the collection device is configured as described in co-pending PCT Patent Application Serial No. US99/09479, filed Apr. 29, 1999, assigned to the assignee of the present invention and hereby incorporated by reference in its entirety. In other embodiments, blood or other sample collection cards or swabs can be used for the collection device 10.

Similarly, the absorbent material 62 can take many forms. In this preferred embodiment, the absorbent material 62 includes a conventional desiccant.

Figure 4:
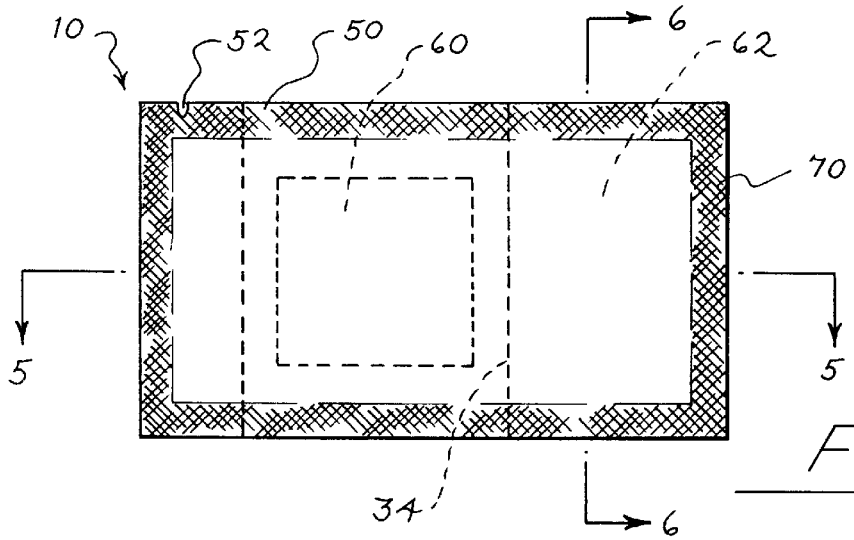
FIG. 4 is a top view showing the fully-assembled sample storage package.

After the collection device 60 and the absorbent material 62 have been loaded into the pouch and the container, respectively, another heat seal 70 is formed as shown by the additional lined region of FIG. 4. This heat seal 70 simultaneously (1) closes off and seals the pouch formed by the first and second sheets and closes off and seals the container formed by the third and fourth sheets. Thus, a single heat sealing operation completes assembly of the storage package. Note that the storage package is hermetically sealed on all four sides by the combination of the heat seal 50 and the heat seal 70. Similarly, the container for the absorbent material 62 is sealed on two sides and one end by the heat seals 50, 70, and the container is closed on the other end by the fold.

Figure 5:
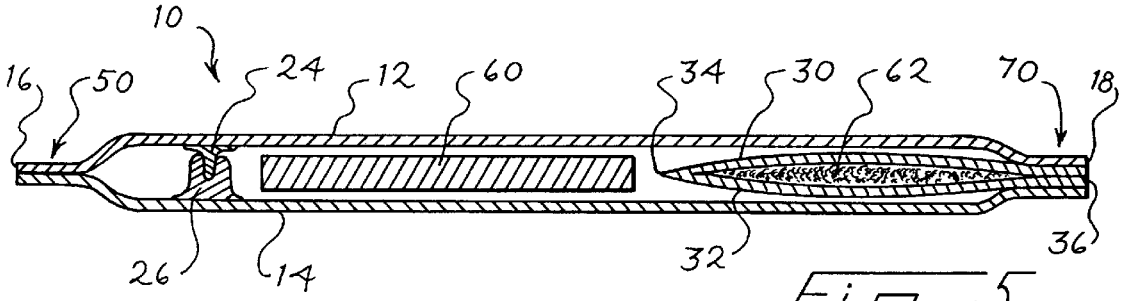
FIG. 5 is a cross-sectional view taken along line 5—5 of FIG. 4.

FIG. 5 shows a longitudinal sectional view through the fully-assembled sample storage package 10. FIG. 5 shows the manner in which the absorbent material 62 is contained within the container formed by the third and fourth sheets 30, 32 and the manner in which the collection device 60 is contained in the pouch formed by the first and second sheets 12, 14. As shown in FIG. 5, the container for the absorbent material 62 is completely disposed within the pouch formed by the first and second sheets 12, 14.

FIG. 5 also shows the manner in which the closure portions 24, 26 are releasably sealed together, as well as the manner in which the first and second sheets 12, 14 and the third and fourth sheets 30, 32 are all heat sealed and bonded together in the region of the second ends 18, 36 by the heat seal 70.

Figure 6:
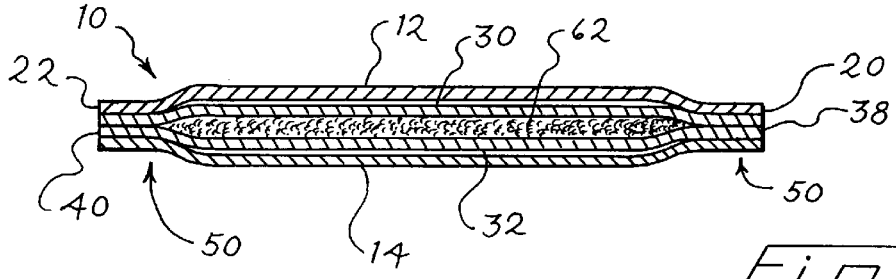
FIG. 6 is a cross-sectional view taken along line 6—6 of FIG. 4.

FIG. 6 is a transverse sectional view of the fully-assembled storage package 10. FIG. 6 shows the manner in which the first and second sheets 12, 14 and the third and fourth sheets 30, 32 are all heat sealed together in the region of the opposed sides 20, 38; 22, 40.

The fully-assembled sample storage package can be provided to a user. The user at an appropriate time tears open the first and second sheets 12, 14 at the notch 52, thereby gaining access to the zip-seal closure 24, 26. The user then opens the zip-seal closure 24, 26, and extracts the collection device 60 from the pouch. The user applies the biological sample to the collection device in any conventional manner, returns the collection device 60 to the pouch, and then reseals the zip-seal closure portions 24, 26. The absorbent material 62 in the container protects the biological sample in the collection device 60 from excessive moisture, as water vapor is drawn through the water vapor permeable material of the third and fourth sheets 30, 32 and is isolated by the absorbent material 62. Because the container formed by the sheets 30, 32 for the absorbent material 62 is secured to the outer sheets 12, 24 at both the sides and one end, there is no danger that the user may remove the absorbent material container from the pouch and fail to storage it or misuse it in some other way.

The fabrication method described above provides the important advantage that the sheets 12, 14, 30, 32 can all be heat sealed together and trimmed in a prefabrication step, prior to the time that the collection device 60 and/or the absorbent material 62 are loaded into the pouch and/or the container. The collection device 60 and the absorbent material 62 can then be loaded shortly before the final heat seal 70 is formed. This is an efficient, cost-effective fabrication technique.

Simply by way of example, the following materials have been found suitable in one preferred embodiment. The sheets 12, 14 can be formed of polyester, metal foil, low density polyethylene composite film having a thickness 4 mils. A suitable material can be obtained from RBL (Baltimore, Md.) under the trade name BF-48. The sheets 30, 32 can be formed of any material that is suitable for containing the absorbent material and sealing as described above. A suitable material can be obtained from DuPont under the trade name Tyvek™. Any conventional absorbent material can be used, including desiccants supplied by Desiccare, Inc. (Richland, Miss.) that include silica gel and/or carbon, and oxygen absorbers sold under the trade name O-BUSTER®. Conventional heat sealing techniques have been found suitable.

Of course, it should be understood that many changes and modifications can be made to the preferred embodiment described above. For example, any suitable closure can be used, and the invention is not limited to use with zip-seal closures. Various single-use closures including adhesive closures can be used in alternative embodiments.

The foregoing preferred embodiment has used heat seals in the regions 50, 70. Heat seals are only one example of a suitable seal, and various adhesive and welding techniques can be substituted in alternative embodiments.

The shape of the storage package of this invention can be varied widely from the example shown in the drawings, and changes both to proportions and shapes are possible. For example, the sides and ends may be curved rather than straight, and various shapes including rectangular or square shapes with square or rounded corners, and elliptical or even circular shapes can be used. In one embodiment, the opposed sides and opposed ends of the sheets may correspond to arcuate curves or even respective arcs of a circular perimeter.

The first and second sheets may be formed of a single piece of folded material, in a manner somewhat similar to that described above in conjunction with the third and fourth sheets. Similarly, the third and fourth sheets may be secured together by some alternate technique instead of the illustrated fold. For example, any of the sealing techniques described above can be substituted in alternative embodiments.

The absorbent material is not limited to desiccant, and in some applications it may be preferred to use a material that absorbs oxygen. In this case, the third and fourth sheets should be formed of a material that is oxygen permeable.

The foregoing detailed description has described only a few of the many forms that this invention can take. For this reason, this detailed description is intended by way of illustration and not by way of limitation. It is only the following claims, including all equivalents, that are intended to define the scope of this invention.

What is claimed is:

1. A biological sample storage package comprising:

a pouch comprising a first sheet material that is impermeable to water vapor, said first sheet material comprising first and second sheets and said pouch comprising first and second opposed ends;

a closure included in the pouch near the first end of the pouch to seal the pouch after a biological sample has been placed in the pouch;

a container comprising a second sheet material that is permeable to at least one of water vapor and oxygen, said second sheet material comprising third and fourth sheets sealed between the first and second sheets near the second end of the pouch such that the pouch and the container are sealed and said container is secured to the first sheet material within in the pouch; and an absorbent material operative to absorb at least one of water vapor and oxygen, said absorbent material disposed in the container.

2. The invention of claim 1 wherein the absorbent material comprises a desiccant.

3. The invention of claim 1 wherein the closure comprises a zip-seal closure.

4. The invention of claim 1 wherein the first and second sheet materials comprise respective polymer films.

5. The invention of claim 1 wherein the container comprises first and second opposed ends and first and second opposed sides;

wherein the first end of the container comprises a fold of the second sheet material connecting the third and fourth sheets; and wherein the second end and the first and second sides of the container are heat sealed to respective portions of the first sheet material between the first and second sheets.

6. The invention of claim 5 wherein the second end and the first and second sides of the container are sandwiched between the first and second sheets.

7. The invention of claim 6 wherein the second end and the first and second sides of the container are heat sealed between the first and second sheets.

8. The invention of claim 1 further comprising a biological sample collection device disposed in the pouch.

9. A biological sample storage package comprising:

first and second sheets comprising a first sheet material that is impermeable to water vapor, said first and second sheets sealed together along two opposed sides and two opposed ends to form a pouch;

third and fourth sheets comprising a second sheet material that is permeable to at least one of water vapor and oxygen, said third and fourth sheets connected together at a first end and sealed between the first and second sheets at the two opposed sides and at one of the two opposed ends of the first and second sheets, said first end spaced from both of the two opposed ends of the first and second sheets, said third and fourth sheets forming a container disposed in the pouch;

an absorbent material disposed in the container, said absorbent material operative to absorb at least one of water vapor and oxygen from the pouch through the container; and a resealable zip-seal closure secured to the first and second sheets and extending at least partially between the two opposed sides near the other of the two opposed ends.

10. The invention of claim 9 further comprising a biological sample collection device disposed in the pouch.

11. The invention of claim 9 wherein the third and fourth sheets are connected together at the first end by a fold region.

12. The invention of claim 9 wherein the absorbent material comprises a desiccant.

13. A method for forming a biological sample storage package, said method comprising:

(a) providing first and second sheets comprising a first sheet material that is impermeable to water vapor, each of said first and second sheets comprising a respective zip-seal closure portion, said zip-seal closure portions sealed together;

(b) positioning third and fourth sheets between the first and second sheets, said third and fourth sheets comprising a second sheet material that is permeable to at least one of water vapor and water, said third and fourth sheets connected at one end;

(c) sealing the first and second sheets together at least along two opposed sides, the act of sealing the first and second sheets together comprising the act of sealing two opposed sides of the third and fourth sheets together and to the first and second sheets; then (d) inserting an absorbent material between the third and fourth sheets, said absorbent material operative to absorb at least one of water vapor and oxygen; and then (e) sealing the first and second sheets together along an end remote from the zip seal closure, said act of sealing the first and second sheets together along the end comprising the act of sealing a portion of the third and fourth sheets together between the first and second sheets to seal the absorbent material between the third and fourth sheets and to create a sealed pouch comprising the first and second sheets.

14. The method of claim 13 wherein the third and fourth sheets are connected together at a fold.

15. The method of claim 13 further comprising:

inserting a biological sample collection device between the first and second sheets after (c) and before (e), said collection device separated from the absorbent material by the third and fourth sheets.

16. The method of claim 13 wherein the absorbent material comprises a desiccant.

17. The method of claim 13 wherein (c) comprises sealing the first and second sheets together along another end near the zip-seal closure portions.

* * * * *